US006067943A

United States Patent [19]

Morin et al.

[11] Patent Number: 6,067,943

[45] Date of Patent: May 30, 2000

[54] CIRCULATING FLUIDIZED BED BOILER WITH IMPROVED NITROGEN OXIDE REDUCTION

[75] Inventors: Jean-Xavier Morin, Neuville Aux Bois; Michel Vandycke, Gambais; Corinne Beal, Voisins le Bretonneux, all of France

[73] Assignee: Alstom Energy Systems SA, Velizy, France

[21] Appl. No.: 09/250,688

[22] Filed: Feb. 16, 1999

[30] Foreign Application Priority Data

Feb. 16, 1998 [FR] France ..... 98 01839

[51] Int. Cl.[7] ..... F22B 1/00

[52] U.S. Cl. ..... 122/4 D; 110/245; 110/345; 422/172

[58] Field of Search ..... 122/4 D; 110/245, 110/345; 422/171, 172

[56] References Cited

U.S. PATENT DOCUMENTS 5,103,773 4/1992 Andersson et al. ..... 110/245
5,315,941 5/1994 Vetterick et al. .
5,342,592 8/1994 Peter-Hoblyn et al. .
5,465,690 11/1995 Viel Lamare et al. .

FOREIGN PATENT DOCUMENTS 0 690 266 A1 1/1996 European Pat. Off. .
37 28557 A1 3/1989 Germany .
2 271 517 4/1994 United Kingdom .
WO 96/21825 7/1996 WIPO .

*Primary Examiner*—Denise L. Ferensic
*Assistant Examiner*—Jiping Lu
*Attorney, Agent, or Firm*—Sughrue, Mion, Zinn, Macpeak & Seas, PLLC

[57] ABSTRACT

The circulating fluidized bed boiler comprises a combustion hearth and a separator cyclone interconnected by a duct which extends along a longitudinal axis and which channels a flow of particles and gas containing nitrogen oxides. It also includes means for injecting into the flow a reagent for reducing nitrogen oxides. Said means comprises at least a first injection tube disposed in a setback of the top portion of the combustion hearth which extends over the duct so as to inject the reagent along the longitudinal axis of the duct in the same direction as the flow.

10 Claims, 2 Drawing Sheets

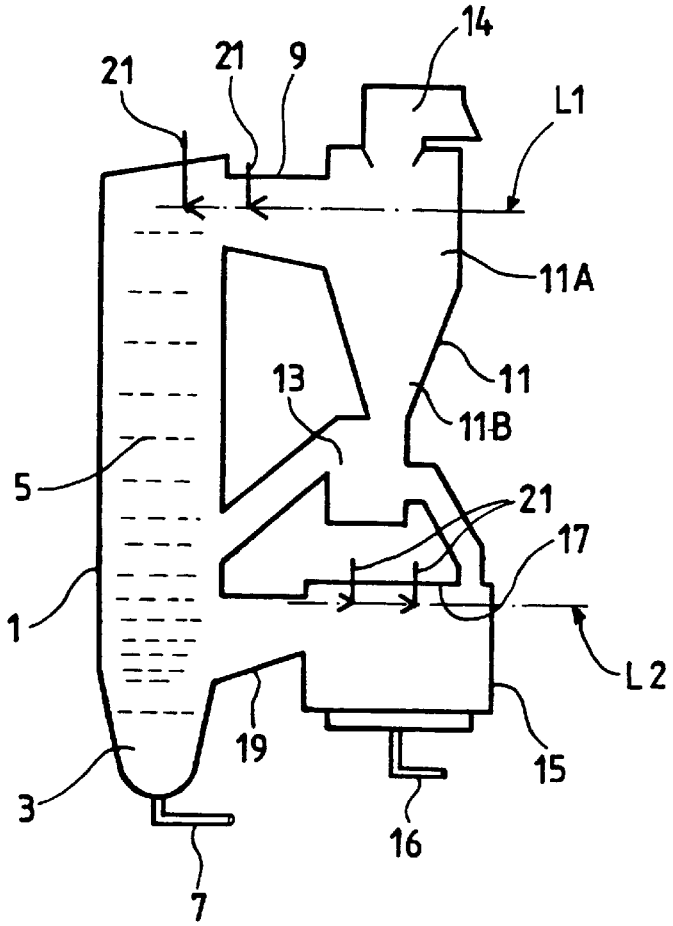
FIG_1
FIG_2
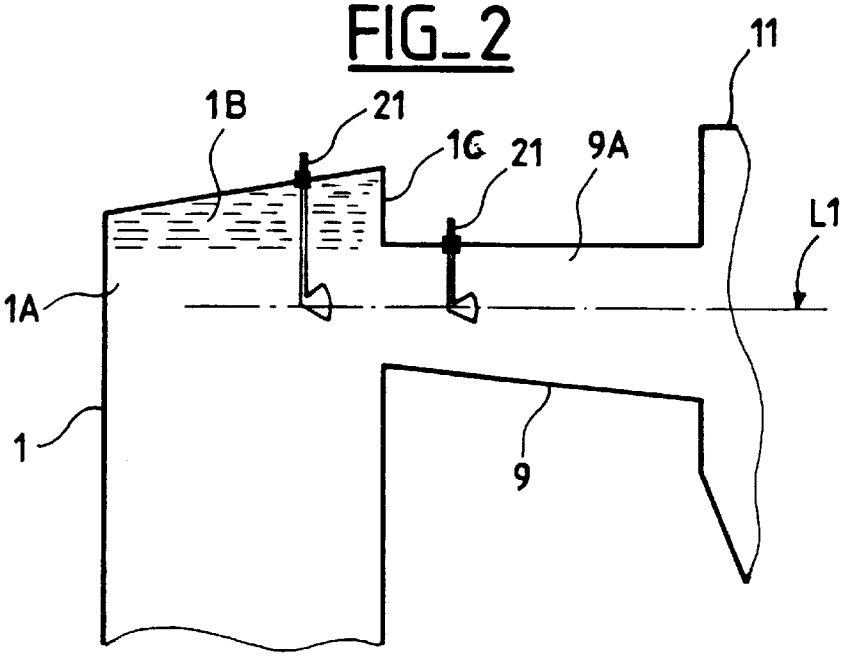

FIG_3
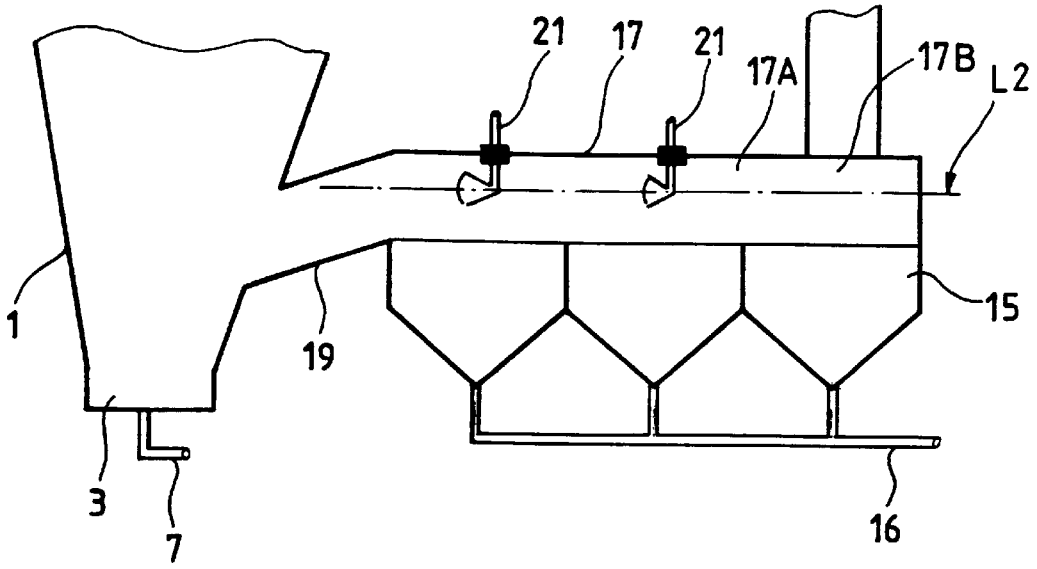
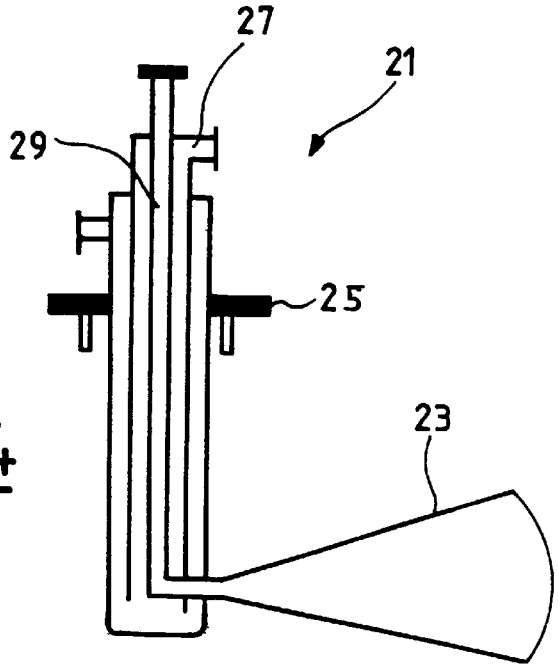
FIG_4

CIRCULATING FLUIDIZED BED BOILER WITH IMPROVED NITROGEN OXIDE REDUCTION

The invention relates to a circulating fluidized bed boiler having a duct which extends along a longitudinal axis and which conveys a flow of particles and gas containing nitrogen oxides, and a mechanism for injecting a reagent into the flow for the purpose of reducing the nitrogen oxides.

BACKGROUND OF THE INVENTION

In a boiler of this type, with a duct connecting the combustion hearth to a separator cyclone, particles are separated out in the separator cyclone and are recycled through the combustion hearth. Gas is evacuated via a chimney after passing through conventional heat exchangers situated downstream from the separator cyclone. Reducing nitrogen oxides into inert molecular nitrogen is a corrective measure which diminishes the amount of nitrogen oxides that are discharged with the gases exhausted by the chimney.

In general, ammonia is injected into the flow of particles and gas in order to reduce the nitrogen oxides by a reaction scheme that is known as non-catalytic selective reduction. It is nowadays accepted that the reduction reaction in the installation is influenced by three main parameters, namely: temperature, transit time, and the mixing of the reactive ammonia with the nitrogen oxides.

European patent application EP 0 690 266, published on Jan. 3, 1996, describes a boiler in which ammonia is injected via an opening formed in the wall of the top portion of the duct, the opening being disposed at a shorter distance from the combustion hearth than the separator cyclone. That method of injection is relatively simple to implement. Nevertheless, injecting through the wall of the duct does not make it possible to achieve complete mixing of the reactive ammonia and the nitrogen oxides. Although the flow of particles and gas is turbulent, it is nevertheless dominated by a speed component that is parallel to the longitudinal axis of the duct and that restricts penetration of the reactive ammonia into a layer that is in contact with the wall of the duct.

SUMMARY OF THE INVENTION

The object of the invention is to improve mixing of the reagent with the nitrogen oxides contained in the gas to enhance reduction of the oxides.

To this end, the invention provides a circulating fluidized bed boiler having a combustion hearth and a separator cyclone interconnected by a duct which extends along a longitudinal axis and which channels a flow of particles and of gas containing nitrogen oxides, and means for injecting into the flow a reagent that enables the nitrogen oxides to be reduced, wherein said means comprises at least a first injection tube disposed in a setback of the top portion of the combustion hearth extending above the duct so as to inject the reagent on the longitudinal axis of the duct and in the same direction as the flow.

With this organization, the reagent is injected into the core of the flow in a region thereof that has low particle density, thereby improving mixing with the nitrogen oxides and increasing the efficiency of reduction.

BRIEF DESCRIPTION OF THE DRAWINGS

Other characteristics and advantages of the invention appear on reading the following description of two embodiments as shown in the drawings.

FIG. 1 is a highly diagrammatic front view of a circulating fluidized bed boiler.

FIG. 2 is a highly diagrammatic view of the FIG. 1 boiler, having at least one injection tube disposed in the top portion of a combustion hearth or of a first duct providing communication between the combustion hearth and a separator cyclone.

FIG. 3 is a highly diagrammatic representation of a FIG. 1 boiler with at least one injection tube disposed in a second duct formed by the top portion of an external dense fluidized bed heat exchanger.

FIG. 4 is a section view through an injection tube.

DETAILED DESCRIPTION OF THE PREFERRED EMBODIMENTS

A circulating fluidized bed boiler, shown diagrammatically in FIG. 1, comprises a combustion hearth 1 extending vertically with a bottom portion that is fed with fuel 3, e.g. crushed coal, and with a flow of air 7 that is directed upwards through the hearth. Combustion takes place within a large mass of fine ash particles 5 that are strongly stirred and that are held in suspension by the flow of air 7 so as to form a fluidized bed with particle density that falls off quickly as a function of height up the hearth. Combustion typically takes place at a temperature of 850 degrees Celsius (° C.) and generates nitrogen oxides NOx.

The flow of air charged with fine particles and with nitrogen oxides is channeled in the top portion of the hearth via a first duct 9 which extends along a longitudinal axis L1 that is substantially horizontal and which opens out into the top portion 11A of a vertically-disposed separator cyclone 11. Because the air flow in the cyclone is circular, the fine particles of ash are separated from the flue gases and they are recycled to the combustion hearth 1 via a fluidized siphon 13. The flue gases 14 leave the separator cyclone 11 and pass through conventional heat exchangers before being exhausted via a chimney.

To make it easier to control the temperature of the hearth, an external dense fluidized bed heat exchanger 15 is placed in parallel with the fluidized siphon 13, and is fed with air 16 and with particles taken from the bottom portion 11B of the separator cyclone 11. A second duct 17 forming a top portion of the external heat exchanger 15 extends parallel to a substantially horizontal longitudinal axis L2 and conveys the flow of particles and gas from the separator cyclone 11 towards the combustion hearth 1 via a fluidized system 19 to recycle the particles.

According to the invention, in order to reduce the nitrogen oxides contained in the gas and the flue gases, a reagent, e.g. ammonia in the gaseous state, is injected by means of at least one injection tube which is disposed so as to release the reagent on the longitudinal axis of a duct so that it flows as a parallel flow with the flow of particle-charged gas, i.e. it flows in the same direction as the particles and gas.

In a first embodiment of the invention, as shown in FIG. 2, each tube 21 is disposed in a top portion 1A of the combustion hearth 1 where the flow of particles and gas is channeled by the first duct 9 so as to be transported to the separator cyclone 11. In this first embodiment, each tube is preferably mounted in a setback 1C of the top portion 1A of the combustion hearth 1 that it extends above the top portion 9A of the first duct 9. The setback 1C creates an impact layer 1B of particles transported by the circulating flow and reduces the particle density in the reagent injection zone.

As can be seen in FIG. 2, in a variant of this first embodiment of the invention, provision is also made to place each injection tube 21 in a top portion 9A of the first duct 9 which channels the flow leaving the hearth 1 towards the inlet of the separator cyclone 11. In this variant, each tube 21 is preferably disposed close to the combustion hearth 1 so as to lengthen transit time in the air flow moving to the entrance into the separator cyclone 11, thereby improving mixing of the injected reagent with the nitrogen oxides contained in the flow.

Advantageously, a plurality of injection tubes 21 are located at a plurality of points across the width of the combustion hearth 1 or of the duct 9 extending perpendicularly to the longitudinal axis L1 so as to improve mixing with the nitrogen oxides.

In a second embodiment of the invention, as shown in FIG. 3, each injection tube 21 is disposed in a second duct 17 formed by a top portion 17A of the external heat exchanger 15 where the carbon is partially diluted in particles coming from the separator cyclone 11. The diluted carbon is subjected to combustion in a large excess of air over the dense fluidized bed and produces nitrogen oxides which are reduced by injecting the reagent. In this second embodiment, each tube 21 is preferably disposed, relative to the flow, downstream from the inlet zone 17B where particles from the separator cyclone 11 enter the second duct 17, thereby lengthening the transit time of the reagent, given that the dilution of carbon in this inlet zone 17 is large.

As shown in FIG. 4, each tube 21 has at least one injection nozzle 23. In both above-described embodiments, each tube 21 is lowered into the combustion hearth or into the first duct 9 or the second duct 17 in a direction which is substantially perpendicular to the longitudinal axis L1 or L2, and the injection nozzle 23 is directed in the flow direction of the particles and the gas so as to inject the reagent in the longitudinal axis of the duct so as to flow in the same direction as the flow of particles and gas.

Each injection tube 21 is fixed in the top portion of the hearth 1 or of the first or second duct 9 or 17 by means of a flange 25 which preferably allows each tube to move in translation perpendicularly to the longitudinal axis of the duct so as to enable it to be lowered into that portion of the hearth or the duct which has the flow with the lowest particle density, thus improving mixing of the reagent with the nitrogen oxides.

Provision is also made for each injection tube to have surface treatment so as to improve its corrosion-resisting properties. Given the temperature of the flow and the abrasive nature of the particles and the gas, each tube is treated by depositing a coating of tungsten carbide or of chromium carbide thereon, e.g. by means of a plasma. To improve the mechanical behavior of the tubes, provision is also made to cool them by means of a flow of water 27. The reagent is injected via a channel 29 which opens out into the injection nozzle 23. The reagent can be gaseous ammonia or droplets of ammonia in solution, or a liquid precursor of ammonia such as urea, in a solution that is propelled by air.

What is claimed is:

1. A circulating fluidized bed boiler comprising:

a combustion hearth and a separator cyclone interconnected by a duct which extends along a longitudinal axis and which channels a flow of particles and of gas containing nitrogen oxides, and means for injecting into the flow a reagent that enables the nitrogen oxides to be reduced, wherein said injection means comprises:

at least a first injection tube disposed in a setback of a top portion of the combustion hearth extending at a height above the duct so as to inject the reagent on the longitudinal axis of the duct and in a same direction as the flow, said setback creating an impact layer of said particles therein and reducing a particle density in the flow of particles in the duct.

2. The boiler according to claim 1, in which each means comprises at least one second injection tube disposed in a top portion of the duct close to the combustion hearth to inject reagent into the duct in the same direction as the flow.

3. The boiler according to claim 1, further comprising an external dense fluidized bed heat exchanger connecting the separator cyclone to the combustion hearth and in which the top portion thereof forms a duct for a flow of particles and gas extending along a longitudinal axis, wherein the injection means further comprises at least one third injection tube disposed in a top portion of the heat exchanger to inject the reagent into said flow.

4. The boiler according to claim 1, in which each injection tube has at least one reagent injection nozzle.

5. The boiler according to claim 1, in which each injection tube is movable in a direction that is substantially perpendicular to the longitudinal axis of the duct.

6. The boiler according to claim 1, in which each injection tube has a cooling circuit, said cooling circuit having a channel into which said reagent is injected, and a surrounding tube into which water is introduced.

7. The boiler according to claim 1, in which each injection tube has a plasma coating of one of tungsten carbide and of chromium carbide for withstanding abrasion by the flow.

8. The boiler according to claim 1, in which the reagent is one of gaseous ammonia, droplets of ammonia in solution, and a liquid precursor of ammonia.

9. A circulating fluidized bed boiler comprising:

a combustion hearth and a separator cyclone interconnected by a duct which extends along a longitudinal axis and which channels a flow of particles and of gas containing nitrogen oxides, and means for injecting into a flow a reagent that enables the nitrogen oxides to be reduced, wherein said injection means comprises:

at least a first injection tube disposed in a setback of a top portion of the combustion hearth extending above the duct so as to inject the reagent on the longitudinal axis of the duct and in a same direction as the flow; and an external dense fluidized bed heat exchanger connecting the separator cyclone to the combustion hearth and in which the top portion thereof forms a duct for a flow of particles and gas extending along a longitudinal axis;

wherein the injection means further comprises at least one second injection tube disposed in a top portion of the heat exchanger to inject the reagent into said flow.

10. A circulating fluidized bed boiler comprising:

a combustion hearth and a separator cyclone interconnected by a duct which extends along a longitudinal axis and which channels a flow of particles and of gas containing nitrogen oxides;

wherein said combustion hearth includes a sloping top portion extending above the duct and which slopes upward in a direction toward said duct; and an injection mechanism for injecting into a flow a reagent that enables the nitrogen oxides to be reduced, wherein said injection mechanism comprises:

at least a first injection tube disposed in said sloping top portion of the combustion hearth at a portion closest to said duct, so as to inject the reagent on the longitudinal axis of the duct and in a same direction as the flow, such that an impact layer of said particles is produced in said sloping top portion of said combustion chamber, thereby reducing a particle density in the flow of particles in the duct.

* * * * *